US009428928B2

(12) United States Patent
Ferriss et al.

(10) Patent No.: US 9,428,928 B2
(45) **Date of Patent: *Aug. 30, 2016**

(54) SWIM SPA WITH PLENUM ARRANGEMENT AT HEAD END

(71) Applicant: Master Spas, Inc., Fort Wayne, IN (US)

(72) Inventors: David A. Ferriss, Fort Wayne, IN (US); Adam C. Riley, Payne, OH (US)

(73) Assignee: Master Spas, Inc., Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/711,595

(22) Filed: May 13, 2015

(65) Prior Publication Data

US 2015/0240509 A1 Aug. 27, 2015

Related U.S. Application Data

(63) Continuation of application No. 11/613,562, filed on Dec. 20, 2006, now Pat. No. 9,038,208.

(51) Int. Cl.

| | |
|---|---|
| ***A47K 3/00*** | (2006.01) |
| ***E04H 4/12*** | (2006.01) |
| ***A63B 69/12*** | (2006.01) |
| ***A61H 33/00*** | (2006.01) |
| ***E04H 4/14*** | (2006.01) |

(52) U.S. Cl.

CPC ..... *E04H 4/12* (2013.01); *A61H 33/60* (2013.01); *A63B 69/125* (2013.01); *E04H 4/14* (2013.01); *Y10S 4/904* (2013.01)

(58) Field of Classification Search

CPC .... F04D 35/00; A63B 69/125; E04H 4/0006

USPC ..... 4/491

See application file for complete search history.

(56) References Cited

U.S. PATENT DOCUMENTS

| | | | | |
|---|---|---|---|---|
| 1,536,875 | A | 5/1925 | Bowen | |
| 1,630,797 | A | 5/1927 | Marwick | |
| 2,035,835 | A | 3/1936 | Räber | |
| 3,222,036 | A | 12/1965 | Lovinggood et al. | |
| 4,001,899 | A * | 1/1977 | Mathis | A63B 69/12 4/489 |
| 4,352,215 | A | 10/1982 | Laing | |
| 4,907,304 | A | 3/1990 | Davidson et al. | |
| 5,044,021 | A * | 9/1991 | Murdock | A63B 69/125 4/488 |
| 5,207,729 | A | 5/1993 | Hatanaka | |
| 5,298,003 | A | 3/1994 | Weihe et al. | |
| 5,662,558 | A | 9/1997 | Shannon, III | |

(Continued)

FOREIGN PATENT DOCUMENTS

| | | |
|---|---|---|
| EP | 0 313 242 | 10/1988 |
| EP | 0 472 976 | 3/1992 |

*Primary Examiner* — Lauren Crane

(74) *Attorney, Agent, or Firm* — Taylor IP, P.C.

(57) ABSTRACT

A swimming pool with a circulating water flow includes a plurality of side walls adjacent a swimming compartment, one of the side walls including an outlet, at least one inlet positioned below and at a lateral side of the outlet, and a plenum arrangement on a side of the one wall opposite the swimming compartment. The plenum arrangement is in communication with each inlet and the outlet. A water propulsion device is positioned within the plenum arrangement and effects a pair of circuitous water flow paths within the swimming compartment. The swimming pool having an absence of a separate return flow plenum arrangement extending along the length of the swimming compartment.

9 Claims, 4 Drawing Sheets

(56) References Cited

U.S. PATENT DOCUMENTS

| | | | |
|---|---|---|---|
| 5,794,280 | A | 8/1998 | Hansen et al. |
| 6,030,180 | A | 2/2000 | Clarey et al. |
| 6,789,278 | B2 | 9/2004 | Shea |
| 2004/0143894 | A1 | 7/2004 | Shea |
| 2006/0045750 | A1 | 3/2006 | Stiles |

* cited by examiner

SWIM SPA WITH PLENUM ARRANGEMENT AT HEAD END

CROSS REFERENCE TO RELATED APPLICATIONS

This is a continuation of U.S. patent application Ser. No. 11/613,562, entitled "SWIM SPA WITH PLENUM ARRANGEMENT AT HEAD END", filed Dec. 20, 2006, which is incorporated herein by reference.

BACKGROUND OF THE INVENTION

1. Field of the Invention

The present invention relates to swimming pools, and, more particularly, to swim spas configured to allow a user to exercise therein.

2. Description of the Related Art

In relatively recent years, people are exercising more to improve short term health and increase longevity. Swimming is known to be a desired form of exercise since it provides cardiovascular benefits with no or low impact. A conventional inground or above-ground swimming pool may be large enough to allow a user to swim laps for exercise. However, such a conventional swimming pool occupies a relatively large footprint, which is not always possible with some urban or suburban locations.

Conventional heated spas, also known as hot tubs, provide certain health benefits to users, but typically are not large enough to allow a user to exercise by swimming. Rather, such spas include primary benefits of soft tissue massage, increased pulmonary circulation, and increased relaxation.

It is known to provide smaller pools which occupy a smaller footprint while still allowing a user to exercise by swimming in place within the pool. Such pools typically include an outlet at the head end of the pool from which a jet of water is directed toward a swimmer, and a separate plenum arrangement positioned outside the swimming compartment (the terms "head end" and "foot end" are used herein with respect to the orientation of a swimmer within the pool). Regardless of the particular plenum configuration, the plenum has an inlet positioned at the foot end of the pool opposite from the water jet outlet, and extends along the outside of the swimming compartment back to the head end of the pool to the water jet outlet. The additional plenum arrangement along the outside of the pool substantially increases the size of the pool, making it more difficult to install such a pool in some locations.

The Assignee of the present invention offers for sale a portable water jet device which may be installed over the edge of a pool to allow a user to swim in place within the pool. If the pool is in the form of a spa, then of course the spa must be large enough to allow the user to swim generally horizontally within the spa. Although this arrangement provides the convenience of using a conventional spa as a swim in place spa, the portable water jet device must be installed on and removed from the spa, and occupies already limited space within the swimming compartment of the spa.

What is needed in the art is a swim spa having an overall size which is more compact than conventional designs, while not affecting the size of the swimming compartment.

SUMMARY OF THE INVENTION

The present invention provides a swimming pool with a circulating water flow, in which a single plenum arrangement is used to create two circuitous water flow paths within the swimming compartment.

The invention comprises, in one form thereof, a swimming pool with a circulating water flow, including a plurality of side walls adjacent a swimming compartment, one of the side walls including an outlet, at least one inlet positioned below and at each lateral side of the outlet, and a plenum arrangement on a side of the one wall opposite the swimming compartment. The plenum arrangement is in communication with each inlet and the outlet. A water propulsion device is positioned within the plenum arrangement and effects a pair of circuitous water flow paths within the swimming compartment. The swimming pool having an absence of a separate return flow plenum arrangement extending along the length of the swimming compartment.

The invention comprises, in another form thereof, a method of operating a swimming pool with a circulating water flow, including the steps of: discharging a jet of water from an outlet at a head end of the swimming pool into a swimming compartment, whereby the jet of water flows in a primary flow path toward the foot end of the swimming compartment; and splitting the primary flow of water to define two circuitous flow paths, each flow path having a return flow path flowing within the swimming compartment in a direction opposite to the primary flow path back toward the head end.

An advantage of the present invention is that the plenum arrangement is simpler and less expensive to manufacture, while still providing a sufficient water flow past a swimmer.

Another advantage is that the overall size of the swim spa is smaller than conventional designs.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
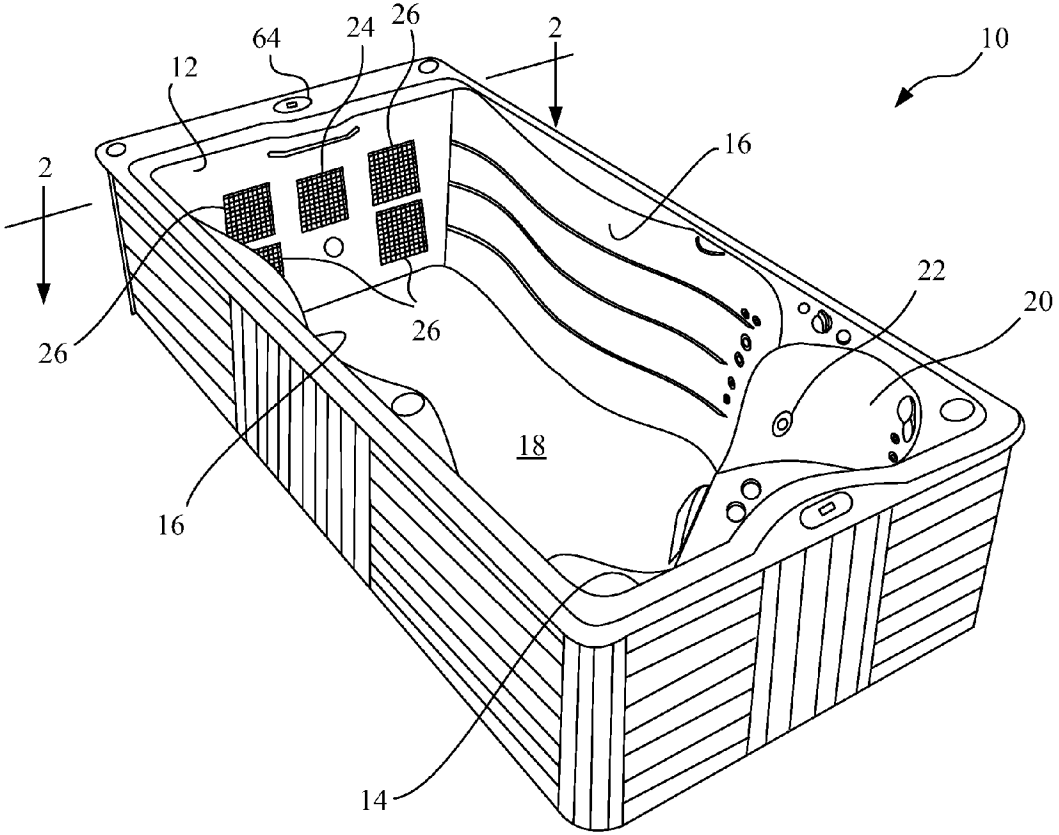
FIG. 1 is a perspective view of an embodiment of a swim spa of the present invention.
Figure 2:
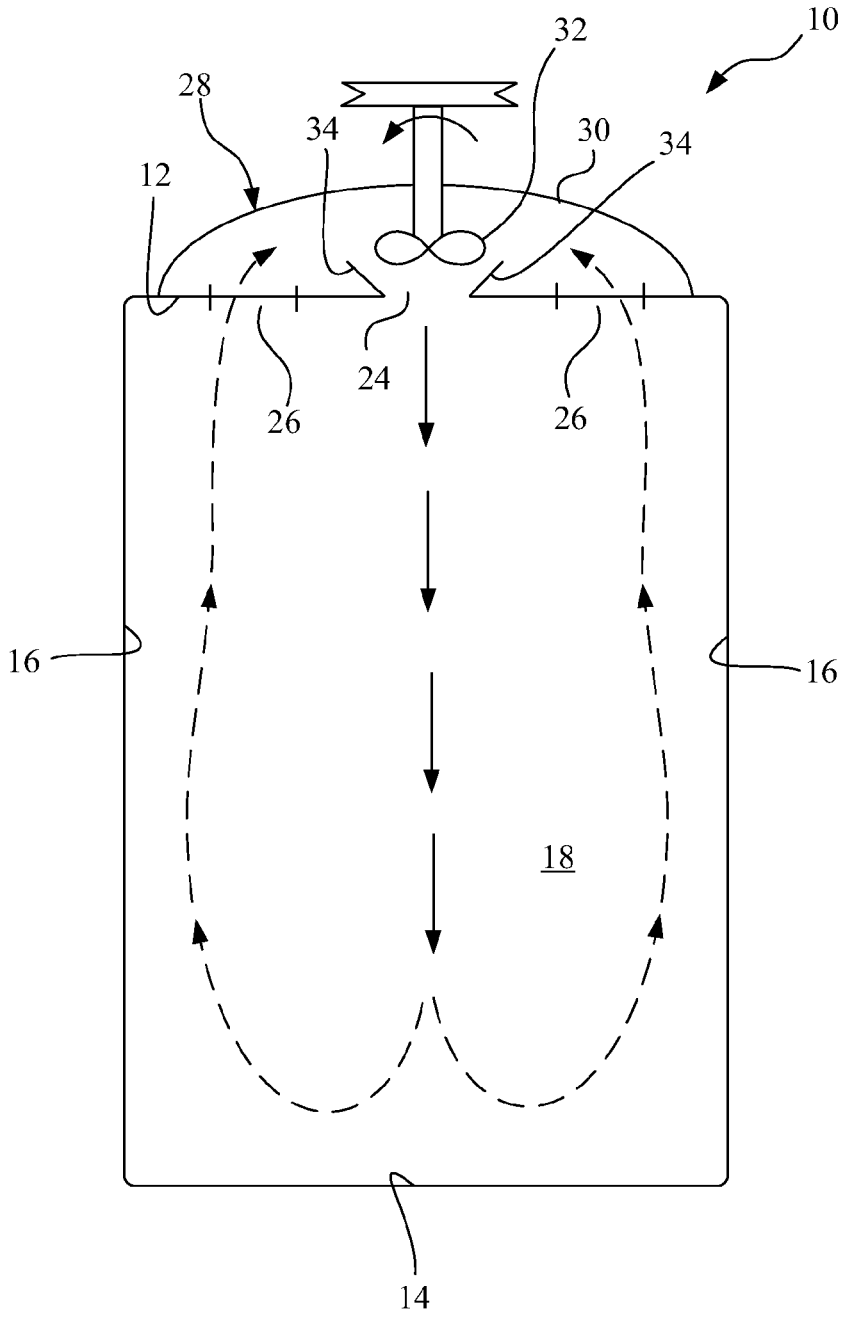
FIG. 2 is a top view of the swim spa of FIG. 1.

Referring now to the drawings, and more particularly to FIGS. 1 and 2, there is shown an embodiment of a swimming pool 10 of the present invention. More particularly, swimming pool 10 is in the form of a swim spa having a circulating water flow which allows a user to swim in place therein for exercise.

Swimming pool 10 includes a plurality of sidewalls 12, 14 and 16 which are adjacent to a swimming compartment 18. Sidewall 12 is at a head end of swimming pool 10, and sidewall 14 is at a foot end of swimming pool 10, relative to the body position of a swimmer within swimming compartment 18. A seat 20 with massage jets 22 is positioned at the foot end of swimming pool 10 for water massage therapy.

Sidewall 12 at the head end of swimming pool 10 includes an outlet 24 and four inlets 26. Outlet 24 is positioned generally at the side-to-side center of sidewall 12 at a height which jets the water toward a swimmer within swimming compartment 18. A pair of inlets 26 are positioned on each lateral side of outlet 24, and have a total cross-sectional area assuring adequate water flow to avoid cavitation, etc.

As shown in FIG. 2, a plenum arrangement 28 is positioned at head end 12 on a side of sidewall 12 opposite from swimming compartment 18. Plenum arrangement 28 is in communication with outlet 24 and inlets 26, and includes a rear wall 30 which is curved to assist in directing water flow toward a water propulsion device 32. To further assist in directing the water flow toward water propulsion device 32 and also decrease the likelihood of cavitation at water propulsion device 32, a pair of flow diverting walls 34 are respectively positioned between outlet 24 and a pair of inlets 26. Flow diverting walls 34 are shown at approximately a 45° angle relative to sidewall 12, but may be positioned at a different angular orientation depending upon the particular application.

Water propulsion device 32, in the embodiment shown, is in the form of a propeller 36 driven by a shaft 38 extending through rear wall 30. Water propulsion device 32 may be differently configured, such as a water jet positioned in line with outlet 24.

Figure 3:
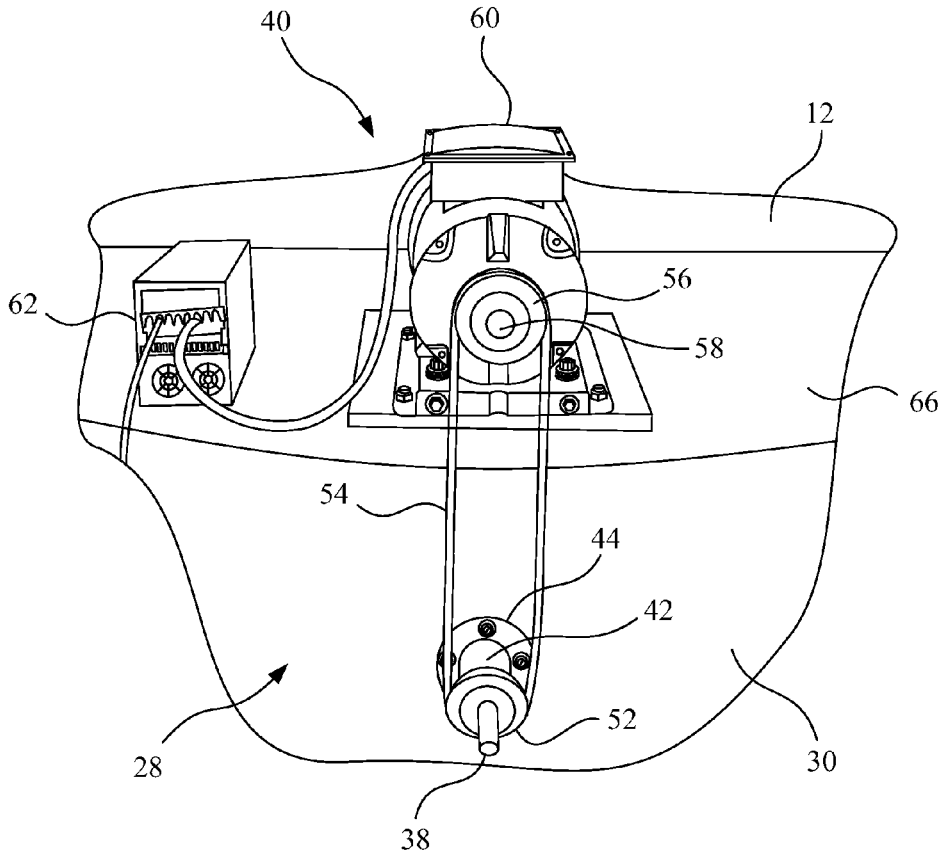
FIG. 3 is a fragmentary, perspective view of the water propulsion system used with the swim spa shown in FIGS. 1 and 2.
Figure 4:
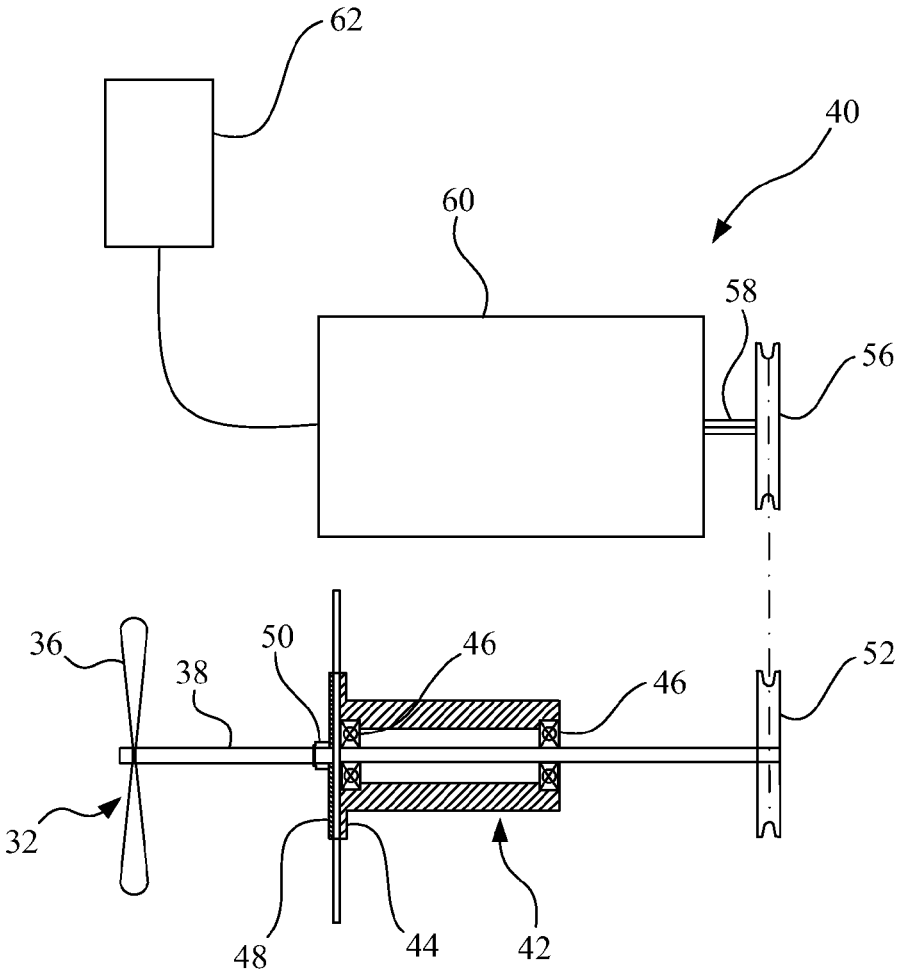
FIG. 4 is a side, sectional view of the water propulsion system shown in FIG. 3.

Referring now to FIGS. 3 and 4, a water propulsion system 40 including water propulsion device 32 will be described in greater detail according to another aspect of the present invention. Water propulsion system 40 includes a hub assembly 42 with a mounting flange 44 positioned at a rear side of rear wall 30 of plenum arrangement 28. Hub assembly 42 includes three bearings 46 rotatably carrying drive shaft 38. Bearings 46 may be configured, e.g., as roller or ball bearings. A reinforcement plate 48 is positioned on a front side of rear wall 30 within plenum arrangement 28, thereby sandwiching rear wall 30 between mounting flange 44 and reinforcement plate 48. Suitable fasteners such as bolts pass through reinforcement plate 48 into threaded openings formed in mounting flange 44. A suitable seal, gasket or sealing compound is utilized at the interface between reinforcement plate 48 and the front side of rear wall 30. The particular size and shape of reinforcement plate 48 may vary, and is intended to provide structural rigidity as well as reduce vibrations at rear wall 30. A water seal 50 is attached to shaft 38 and seals the front bearing assembly 46 and prevents water from flowing into hub assembly 42. The particular configuration of water seal 50 may vary.

Pulley 52 is carried by an end of shaft 38 opposite from propeller 36. Pulley 52 is driven by a belt 54 carried by drive pulley 56, which in turn is rotatably driven by an output shaft 58 extending from electric motor 60. In the embodiment shown, electric motor 60 is a three phase motor which may be selectively controlled using a controller 62. Controller 62 receives single phase electrical power from an input source, such as line voltage, and converts the single phase input to a three phase output. A user input 64 in the form of a keyed digital display is positioned at the top of sidewall 12 to allow a swimmer to adjust the speed of electric motor 60, which in turn adjusts the velocity of the output stream of water from outlet 24. Electric motor 60 may be mounted to the top of a top wall 66 of plenum arrangement 28 as shown in FIG. 3, or may be mounted at another suitable location.

Although controller 62 is shown as an electronic controller with appropriate hardware and/or software, it is also possible that controller 62 can be a variable frequency drive, rheostat, potentiometer, etc.

During use, a swimmer uses user input 64 to set the flow velocity of the jet of water which is discharged from outlet 24 at the head end of swimming pool 10. The water is discharged into swimming compartment 18, whereby the jet of water flows in a primary flow path toward a swimmer within swimming compartment 18. As the water flows past the swimmer toward the foot end of swimming pool 10, the water is divided into two circuitous flow paths, with each return flow path along a respective sidewall 16 being in a direction opposite to the primary flow path from outlet 24. Each divided water flow then flows through a corresponding pair of inlets 26 at a lateral side of outlet 24, then proceeds in a laterally inward direction within plenum arrangement 28 toward outlet 24. The water flows around each flow diverting wall 34 to water propulsion device 32. The merged return flows are then discharged through outlet 24 in the primary flow path toward the swimmer. This split flow of water into two circuitous flow paths within swimming compartment 18 continues during operation of water propulsion device 32.

Unlike previous swim spas having a circulating water flow, the swim spa of the present invention does not utilize separate plenum arrangements which extend along the length of the swim spa outside of the swimming compartment. Rather, the entire plenum arrangement is provided at the head end of the swim spa which reduces the amount of space which is required for installation and operation. By using a plenum arrangement with a single outlet and multiple inlets with a total combined surface area which is sufficient to ensure adequate water flow, a simple, highly effective and compact swim spa is provided. The plenum arrangement by itself is an advance over conventional designs. However, the water propulsion system used with the plenum arrangement of the present invention also provides further advantages in compactness and drive reliability. In contrast with other shaft driven designs having a motor mounted directly to the end of the shaft, the motor is mounted directly on top of the plenum arrangement which decreases the overall size of the swim spa.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claim.

What is claimed is:

1. A swimming pool with a circulating water flow, comprising:

a plurality of side walls adjacent a swimming compartment, one of said side walls including an outlet;

at least one inlet positioned below and to each lateral side of said outlet;

a plenum arrangement on a side of said one wall opposite said swimming compartment, said plenum arrangement in communication with each said inlet and said outlet; and a water propulsion device positioned within said plenum arrangement, said water propulsion device effecting a pair of circuitous water flow paths within said swimming compartment, the swimming pool having an absence of a separate return flow plenum arrangement extending along the length of the swimming compartment.

2. The swimming pool of claim 1, wherein said pair of circuitous water flow paths include a common primary flow path from said outlet, and said flow paths being divided into at least two return flow paths to a respective said at least one inlet in a direction generally opposite to said primary flow path.

3. The swimming pool of claim 2, wherein each said circuitous water flow path flows through a corresponding said at least one inlet at a lateral side of said outlet, then laterally inward toward said outlet, and then merges with the other said circuitous water flow path prior to exiting said outlet.

4. The swimming pool of claim 3, wherein each said circuitous water flow path is positioned entirely within said swimming compartment and said plenum.

5. The swimming pool of claim 2, wherein said water propulsion device comprises a propeller.

6. The swimming pool of claim 5, wherein said plenum arrangement includes a rear wall, and including an electric motor positioned outside said plenum and a drive shaft coupled with said motor, said drive shaft extending through said rear wall of said plenum in line with said outlet, said propeller mounted to an end of said drive shaft opposite said motor.

7. The swimming pool of claim 1, wherein said plenum arrangement includes a pair of flow diverting walls, each said flow diverting wall positioned between said outlet and a corresponding said at least one inlet.

8. The swimming pool of claim 1, wherein said plurality of side walls include a foot end wall at a foot end of the swimming pool, said foot end wall having a curved surface.

9. The swimming pool of claim 8, wherein said foot end wall additionally includes at least one seat.

* * * * *